United States Patent [19]

Shinonome et al.

[11] Patent Number: 4,617,235

[45] Date of Patent: Oct. 14, 1986

[54] ANTISTATIC SYNTHETIC FIBERS

[75] Inventors: Osami Shinonome; Takasi Ikeda; Yoshihiro Kanmuri; Fumio Matuoka, all of Kyoto, Japan

[73] Assignee: Unitika Ltd., Hyogo, Japan

[21] Appl. No.: 612,949

[22] Filed: May 23, 1984

[30] Foreign Application Priority Data

May 23, 1983 [JP] Japan ..... 58-91223
Dec. 14, 1983 [JP] Japan ..... 58-236579

[51] Int. Cl.[4] ..... D02G 3/00

[52] U.S. Cl. ..... 428/374; 428/373; 525/444; 525/408; 525/425

[58] Field of Search ..... 525/408, 444; 428/373, 428/374

[56] References Cited

U.S. PATENT DOCUMENTS

| | | | |
|---|---|---|---|
| 3,329,557 | 7/1967 | Magat | 525/408 |
| 3,549,724 | 12/1970 | Okazaki | 525/408 |
| 3,557,039 | 1/1971 | McIntyre | 525/444 |
| 3,557,055 | 1/1971 | Bonnard | 525/444 |
| 3,577,308 | 5/1971 | Van Drunken | 428/374 |
| 3,652,713 | 3/1972 | Okazaki | 525/444 |
| 3,681,189 | 8/1972 | Matsui | 428/374 |
| 3,725,192 | 4/1973 | Ando | 428/373 |
| 3,968,307 | 7/1976 | Matsui | 428/374 |
| 4,006,123 | 2/1977 | Samuelson | 428/373 |
| 4,024,205 | 5/1977 | Login | 525/295 |
| 4,035,441 | 7/1977 | Endo | 525/444 |
| 4,230,838 | 10/1980 | Foy | 525/408 |
| 4,257,928 | 3/1981 | Vachon | 525/295 |
| 4,304,801 | 12/1981 | Newkirk | 525/444 |
| 4,336,685 | 6/1982 | Eisenstein | 525/444 |
| 4,390,687 | 6/1983 | Tung | 525/295 |

*Primary Examiner*—Lewis T. Jacobs
*Assistant Examiner*—Patricia A. Short
*Attorney, Agent, or Firm*—Sughrue, Mion, Zinn, Macpeak, and Seas

[57] ABSTRACT

Antistatic synthetic fibers composed of (A) a fiber-forming synthetic polymer and (B) a block copolymer containing a polyalkylene oxide component, the block copolymer (B) being incorporated in the polymer (A) substantially continuously along the fiber axis in the form of bands or a network.

9 Claims, 5 Drawing Figures

ANTISTATIC SYNTHETIC FIBERS

BACKGROUND OF THE INVENTION

1. Field of the Invention

This invention relates to synthetic fibers having excellent antistatic properties.

2. Description of the Prior Art

It is known that one defect of synthetic fiber products such as products of polyester or polyamide fibers is their propensity to build up static charges which lead to electrostatic generated problems such as the occurrence of crackling sounds, clinging to the human body and the adhesion of dust to the fibers. Surface-treating of fibers with an antistatic agent and inclusion of an antistatic agent in fibers are two general methods of controlling these electrostatic caused problems. The former method has the defect that the antistatic agent drops off upon laundering, rubbing, etc. and the antistatic effect is reduced. In contrast, the latter method is superior in that the antistatic effect is long lasting.

It is well known that polyalkylene oxide-type compounds are effective as antistatic agents. In particular, incorporating a block copolymer containing a polyalkylene oxide component is considered to be most suitable for obtaining fibers having a permanent antistatic effect. When, however, this block copolymer is introduced into fibers by an ordinary blending method, the polyalkylene oxide component tends to be confined within the molecules of the fibers with reduced mobility, and, therefore, cannot readily produce an antistatic effect.

In an attempt to circumvent this problem, U.S. Pat. No. 4,034,441, for example, proposes fibers in which a block copolymer containing a polyalkylene oxide component is dispersed as fine striae along the fiber axis. With these fibers, however, the reduction of the mobility of the polyalkylene oxide component cannot be prevented sufficiently, and electrostatic-induced problems tend to occur in an atmosphere having a low humidity.

SUMMARY OF THE INVENTION

The present inventors have made extensive investigations in order to provide antistatic synthetic fibers which are free from the aforesaid defects. These investigations have now led to the discovery that by distributing a polyalkylene oxide-containing block copolymer in the form of bands or a network in fibers, the mobility of the polyalkylene oxide segments is increased, and fibers having good and durable antistatic properties can be obtained.

Thus, according to this invention, there are provided antistatic synthetic fibers composed of (A) a fiber-forming synthetic polymer and (B) a block copolymer containing a polyalkylene oxide component, the block copolymer (B) being incorporated in the polymer (A) substantially continuously along the fiber axis in the form of bands or a network.

DETAILED DESCRIPTION OF THE INVENTION

Figure 1:
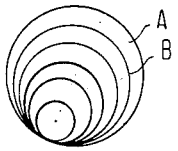
FIGS. 1 to 3 are embodiments of the fibers of this invention.

The fiber-forming synthetic polymer (A) used in this invention may include, for example, melt-spinnable polymers, for example polyethylene terephthalate, polybutylene terephthalate, poly-1,4-cyclohexylene dimethylene terephthalate, poly-p-ethyleneoxybenzoate and polyesters containing the above as main components, nylon-6, nylon-12, nylon-46, nylon-66 and nylon-610, and polyamides containing these specific nylons as main components, and polyethylene, polypropylene and polyolefins containing the above specific polyolefins as main components; and polymers which can be spun by wet-spinning, dry-spinning or emulsion-spinning techniques. Thus, the present invention is believed usable with, in general, synthetic fibers requiring antistatic protection.

The block copolymer (B) containing a polyalkylene oxide component used in this invention denotes a block copolymer containing a polyalkylene oxide segment such as polyethylene oxide, polypropylene oxide, or an ethylene oxide/propylene oxide copolymer as a copolymer component.

Specifically, block copolyether esters, block copolyether amides and block copolyether ester amides obtained by adding polyalkylene oxide compounds having at least one (preferably only two) ester- or amide-forming functional group such as a hydroxyl, carboxyl, alkoxycarbonyl or amino group during the synthesis of polyesters, polyamides and polyesteramides are suitable, and they can be obtained by usual, known polycondensation methods.

Specific examples of components capable of forming the polyesters, polyamides and polyesteramides include dicarboxylic acids such as adipic acid, sebacic acid, terephthalic acid, isophthalic acid, naphthalic acid, and 5-alkali metal (sodium or potassium) isophthalic acids; diols such as ethylene glycol, propylene glycol, diethylene glycol, 1,4-cyclohexanedimethanol and xylylene glycol; hydroxy acids such as epsilon-hydroxycaproic acid and p-beta-hydroxyethoxybenzoic acid; lactones such as epsilon-caprolactone; diamines such as ethylenediamine, tetramethylenediamine, hexamethylenediamine, bis(p-aminocyclohexyl)methane, piperazine and xylylenediamine; amino acids such as epsilon-aminocaproic acid and omega-aminododecanoic acid; and lactams such as epsilon-caprolactam and laurinlactam.

The polyalkylene oxide suitably has a number average molecular weight of 400 to 20,000, preferably 800 to 10,000. The suitable amount of the polyalkylene oxide component in the block copolymer (B) is 10 to 90% by weight, preferably 20 to 70% by weight.

When certain modified polyalkylene oxides, for example, a compound obtained by the addition of an alkylene oxide to a bisphenol compound such as bisphenyl A [2,2-bis(p-hydroxyphenyl)propane] or bisphenol S [bis(p-hydroxyphenyl)sulfone], are used as the polyalkylene oxide component, it imparts the advantage of increasing the heat resistance of the resulting fibers.

The use of a hydrophilic component such as a 5-alkali metal sulfoisophthalic acid or N,N'-bis(amino-n-propyl)-piperazine as a polyester- or polyamide-forming component, or the incorporation of an organic or inorganic ionic compound produces an effect of increasing the antistatic activity of the block copolymer, and is preferred.

Preferably, the polymers (A) and (B) have affinity for each other (adhesion). If their affinity for each other is poor, the resulting fibers tend to undergo fibrillation. Usually, therefore, such combinations as (1) a polyester (A) and a block copolyether ester (B) and (2) a polyamide (A) and a block copolyether amide (B) are selected. But, depending upon the end use of the fibers, a combination of the polymers (A) and (B) which have poor affinity for each other may be chosen in order to positively fibrillate the fibers.

The characteristic feature of the fibers of this invention is that the block copolymer (B) is included in the polymer (A) substantially continuously along the fiber axis in the form of (i) a plurality of spaced-apart bands, longitudinally intersecting the polymer (A) portion of the fibers, or (ii) a network formed of connecting fibrils of component (B).

Figure 2:
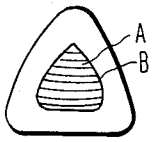

FIGS. 1 and 2 show examples of the cross-section of the fibers in the case of (i) (In FIG. 2, the fibers are sheath-core composite fibers in which a composition of (A) and (B) is coated with another polymer). This pattern is continuous along the fiber axis. The suitable number of bands in this case is 3 to 50, preferably 5 to 30. A condition in which the number of the bands increases excessively, i.e. a condition in which the component (B) is almost finely dispersed, should be avoided.

Figure 3:
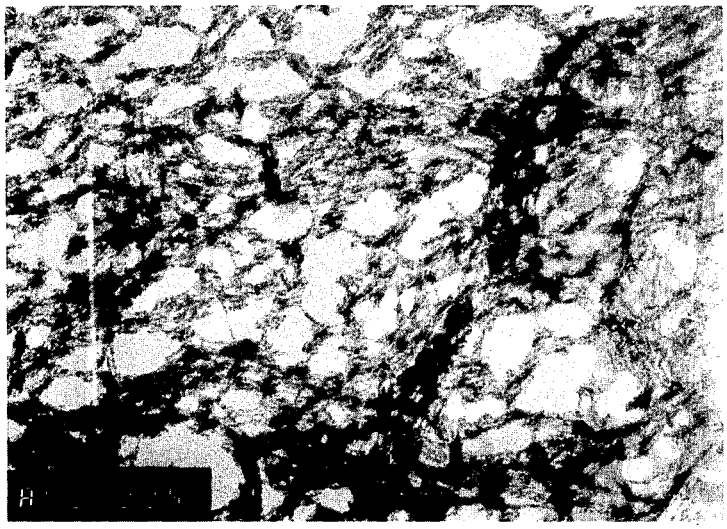

FIG. 3 shows an example of the pattern (ii) (this Figure was obtained by dyeing the fibers of Example 5 with osmic acid, dissolving the polyethylene terephthalate portion in o-chlorophenol, and observing the fiber under an electron microscope with a magnification of 75,000). It is seen that the block copolymer is present in the form of a network in the fibers.

The component (B) produces a great antistatic effect when it is distributed in the form of (i) or (ii) described above. In view of the antistatic effect, spinnability and the properties of the fibers, the suitable content of the polyalkylene oxide in the fibers is 0.5 to 15% by weight, preferably 1 to 10% by weight. The band portions or the net portion need not always be composed of the block copolymer (B) alone, but may contain another polymer component in a proportion which does not reduce the antistatic effect. [In this case, the concentration of the component (B) in the band or net portions is preferably at least 50% by weight.]

Figure 4A:
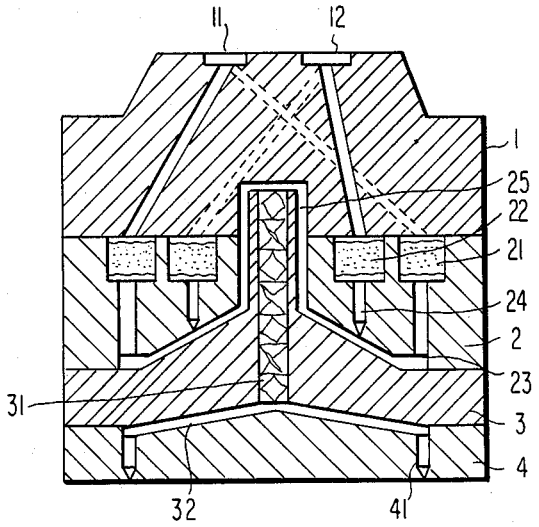
FIG. 4 shows one example of a spinneret device used to obtain the fibers of this invention.
Figure 4B:
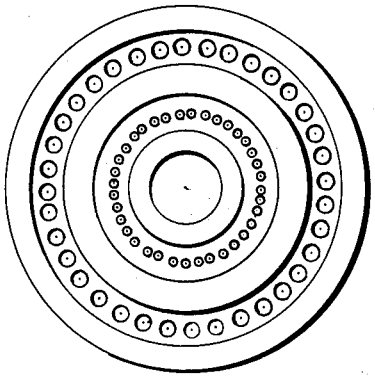

The fibers having the form specified in this invention can be obtained, for example, by using a co-spinning spinneret device shown, for example, in FIG. 4. FIG. 4(*a*) is a sectional view of the spinneret device, and FIG. 4(*b*), is a top plan view of a filter distribution plate excluding a filter material. The polymer (A) and the block copolymer (B) are separately melted or dissolved, and introduced respectively from 11 and 12 of a top cap 1. They are respectively filtered at filter portions 21 and 22 of a filtration distribution plate 2. The polymer (A) passes through a plurality of flow passages 23, spreads uniformly in a composite flow passage 25, and is then conducted to the top portion of a static mixer 31 (preferably composed of 2 to 7 mixer elements; if the number of the elements is too large, the dispersion of the polymer tends to become fine) provided in an intermediate plate 3. In the meantime, the block copolymer (B), after filtration in the filter portion 22, is discharged from a plurality of extrusion orifices 24 and becomes fine streams in the uniform flow of the polymer (A) and thus forms a composite stream. Thereafter, it is introduced into the top portion of the static mixer 31 from the composite flow passage 25. The mixed flow obtained in the static mixer 31 passes through a re-distribution flow passage 32, is introduced into an introduction hole 41 of a spinneret plate 4, and spun. Where a wire mesh is not provided in the re-distribution flow passage 32, the copolymer (B) is dispersed in the form of bands [in the case of (i)]. If a wire mesh is provided there, the copolymer (B) is dispersed in the form of a network [in the case of (ii)]. [The wire mesh suitably has a size of 10 to 500 mesh, preferably 20 to 300 mesh. If the size of the wire mesh is too fine, the dispersion of the copolymer (B) becomes fine and does not form a network, and consequently, reduces the antistatic effect of the copolymer (B).]

By the foregoing procedure, the copolymer (B) is incorporated in the form of bands or a network.

The fibers of this invention have such a structure that the block copolymer (B) is incorporated in the special pattern described above in the polymer (A). Needless to say, fibers obtained by co-spinning a composition of these polymers (A) and (B) distributed in this pattern as one component and another polymer component in a bi-metal pattern or a sea-and-island pattern are also included within the fibers of this invention. In particular, composite fibers (see FIG. 2) composed of the aforesaid composition in accordance with this invention as a core and the other polymer component as a sheath have excellent chemical resistance and light resistance.

Another characteristic feature of this invention is that the antistatic properties of the fibers of this invention are firther improved by crimping the fibers under heat.

As a matter of course, the fibers of this invention may further contain conventional additives such as fire retardants, heat stabilizers, light stabilizers, delusterants, and coloring agents.

The following examples illustrate the present invention more specifically.

The antistatic properties in these examples were assessed by measuring the triboelectric charge voltage of a sample fiber in an atmosphere kept at 20° C. and a relative humidity of 35% by means of a rotary static tester of Koa Shokai K. K. using a cotton cloth as a rubbing means.

All parts in these examples are by weight.

EXAMPLE 1

A reactor equipped with a stirrer was charged with 60 parts of an oligomer (number average degree of polymerization 4) obtained by the esterification reaction of terephthalic acid with ethylene glycol, 40 parts of polyethylene oxide (number average molecular weight 3,000) having hydroxyl groups at both ends and 0.02 part of antimony trioxide, and the polycondensation was carried out for 3 hours at 270° C. and 0.2 mmHg to form a block copolymer ($B_1$).

The copolymer ($B_1$) was melted at 270° C. in an extruder, and ordinary polyethylene terephthalate ($A_1$) was melted at 285° C. in another extruder. These molten polymers [the weight ratio of ($A_1$):($B_1$) was 90:10] were fed into a co-spinning spinneret device of the type shown in FIG. 4 (having 5 static mixer elements and not including a wire mesh), and spun at 280° C., and wound up at 1,500 m/min. to form undrawn filaments. The filaments were then drawn to 3.2 times their original length at 90° C. to obtain a drawn yarn (150 d/48 f). No filament breakage occurred, and the spinnability of the polymers was good. The drawn yarn had the cross-sectional shape shown in FIG. 1.

Then, the drawn yarn was false-twisted by a false twister (Model ST-6 made by Mitsubishi Heavy Industries, Co., Ltd.) with the heater temperature being 200° C. and the number of twists being 2,340 T/m to obtain a textured yarn.

The drawn yarn (non-false-twisted yarns) and the false-twisted yarn were each knitted, scoured, and dyed in a bath containing a blue disperse dye at 130° C. for 40 minutes. The triboelectric charge voltages of these cloths were measured, and found to be 900 V for the cloth from the drawn yarn and 300 V for the cloth from the false-twisted yarn. These properties did not change even when the cloths were laundered in a home washer repeatedly 30 times.

COMPARATIVE EXAMPLE 1

A cloth composed of ordinary polyethylene terephthalate fibers had a triboelectric charge voltage of 4,000 V.

COMPARATIVE EXAMPLE 2

When in Example 1, the number of the static mixer elements was changed to 12, the copolymer ($B_1$) was finely dispersed and not incorporated either in the form of bands or in the form of a network.

The antistatic properties of the resulting drawn yarn were assessed by the same operation as in Example 1. The dyed cloth showed a triboelectric charge voltage of 2,500 V.

COMPARATIVE EXAMPLE 3

When in Example 1, the mixed polymer flow leaving the static mixer elements was spun after it had been passed through a wire mesh with a size of 1,000 mesh, the copolymer ($B_1$) was finely dispersed and not incorporated either in the form of bands or in the form of a network.

The antistatic properties of the resulting drawn yarn were assessed by the same operation as in Example 1. The dyed cloth showed a triboelectric charge voltage of 3,000 V.

EXAMPLES 2 TO 4

A reactor was charged with 64 parts of an oligomer (number average degree of polymerization 4) obtained by the esterification reaction of terephthalic acid with ethylene glycol, 33 parts of an ethylene oxide adduct of bisphenol A (the adduct having a number average molecular weight of 4,000), 3 parts of bis(hydroxyethyl) 5-sodium-sulfoisophthalate and 0.02 part of antimony trioxide, and the polycondensation was carried out in the same way as in Example 1 to give a block copolymer ($B_2$).

The copolymer ($B_2$) and polyethylene terephthalate ($A_1$) were co-spun in varying weight ratios and drawn by nearly the same operation as in Example 1 to give three kinds of drawn yarns (75 d/36 f) having a tenacity of 4.3 to 4.7 g/d and an elongation of 33 to 36%. These yarns all had the cross-sectional shape shown in FIG. 1.

These drawn yarn were woven into taffetas at a density of 110 warps/2.54 cm and 100 wefts/2.54 cm, scoured, and then dyed in a bath containing a blue disperse dye at 135° C. for 30 minutes.

As is clear from the triboelectric charge voltages of the dyed cloths shown in Table 1., all of these woven fabrics had good antistatic properties. These properties scarcely changed even when the fabrics were laundered in a homo washer repeatedly 30 times.

TABLE 1

| Example | ($A_1$):($B_2$) weight ratio | Triboelectric charge voltage (V) |
|---|---|---|
| 2 | 95:5 | 500 |
| 3 | 93:7 | 400 |
| 4 | 90:10 | 200 |

EXAMPLES 5 AND 6 AND COMPARATIVE EXAMPLE 4

In the co-spinning spinneret device shown in FIG. 4, the number of the static mixer elements were changed to 5, and the various wire meshes shown in Table 2 were provided in the re-distribution flow passage 32.

The polymers ($A_1$) and ($B_2$) were supplied in a weight ratio of 90:10, and co-spun, drawn, woven, scoured, and dyed in the same way as in Examples 2 to 4.

The triboelectric charge voltages of the dyed clothes are shown in Table 2. It is clearly seen from Table 2 that the copolymer ($B_2$) showed a good antistatic effect as a result of being incorporated in a network form in the polymer ($A_1$).

TABLE 2

| Run No. | Mesh size of the wire mesh | Formation of a network | Triboelectric Charge voltage of the dyed cloth (V) |
|---|---|---|---|
| Example 5 | 24 | Yes (FIG. 3) | 280 |
| Example 6 | 78 | Yes | 300 |
| Comparative Example 4 | 1,000 | No | 1,700 |

(Note): The network was observed by the method described hereinabove in the specification. In Comparative Example 4, the copolymer ($B_2$) was finely dispersed.

EXAMPLE 7

Block copolymer ($B_2$) was melted in an extruder at 270° C., and polyethylene terephthalate ($A_1$) was melted in another extruder at 285° C. By using a spinneret device obtained by modifying the device shown in FIG. 4 so as to supply a part of polymer passed through the flow-passages 23 along the wall surface of the introduction hole 41, these polymers were spun from 36 nozzles to form composite filaments of the type shown in FIG. 2 [the sheath portion was formed of 50 parts of ($A_1$) and the core portion was formed of 43 parts of ($A_1$) and 7 parts of ($B_2$)], taken up at 1,400 m/min., divided into two sets of 18 filaments, and separately wound up.

One undrawn yarn was drawn at a draw ratio of 2.8 and a temperature of 90° C., and heat-treated [filament group (I)]. The other undrawn yarn was drawn under the same conditions but not heat-treated [filament group (II)].

The filament groups (I) and (II) were plied. The difference in boiling water shrinkage between (I) and (II) was about 9%.

The resulting yarn was woven into a taffeta, and subjected to an surface dissolution/erosion treatment at 100° C. for 40 minutes in a 4% aqueous solution of sodium hydroxide (the weight of the fabric decreased 15%). The fabric was then dyed under the conditions described in Example 1 to give a silk-like fabric. This fabric had a triboelectric charge voltage of 400 V.

EXAMPLE 8

A block copolymer ($B_3$) was obtained by co-polycondensing 60 parts of caprolactam, 4 parts of N,N'-bis-(amino-n-propyl)piperazine, 33 parts of polyethylene oxide having amino groups at both ends (number average molecular weight 3,000), and 3 parts of adipic acid.

The block copolymer ($B_3$) was melted at 260° C., and ordinary nylon 6 ($A_2$), at 265° C. The polymers ($A_2$) and ($B_3$) were co-spun at 90:10 from the co-spinning spinneret device used in Example 1 at 265° C., and wound up at 1,000 m/min. to obtain undrawn filaments. The filaments were then cold-drawn at a draw ratio of 3.0 to obtain a drawn yarn (70 d/48 f). The drawn yarn had the cross-sectional shape shown in FIG. 1.

The drawn yarn was woven, scoured, and dyed in a bath containing a blue acid dye at 98° C. for 1 hour. The dyed fabric had a triboelectric charge voltage of 800 V, and showed good antistatic properties.

While the invention has been described in detail and with reference to specific embodiments thereof, it will be apparent to one skilled in the art that various changes and modifications can be made therein without departing from the spirit and scope thereof.

What is claimed is:

1. Antistatic synthetic fibers composed of (A) a fiber-forming polyester and (B) a block copolyether ester synthesized from four components (i), (ii), (iii) and (iv), wherein component (i) is a poly alkylene oxide which is selected from the group consisting of polyethylene oxide, polypropylene oxide, polyethylene oxide-polypropylene oxide copolymer and ethylene oxide or propylene oxide adduct of a bisphenol compound; component (ii) is a dicarboxylic acid which is selected from the group consisting of adipic acid, sebacic acid, terephthalic acid, isophthalic acid and naphthalic acid; component (iii) is a diol which is selected from the group consisting of ethylene glycol, propylene glycol, diethylene glycol, 1,4-cyclohexanedimethanol and xylylene glycol; and component (iv) is 5-alkali metal sulfoisophthalic acid, the block copolyether ester (B) being incorporated in the polyester (A) substantially continuously along the fiber axis in the form of a plurality of spaced-apart bands, logitudinally intersecting the polyester (A) portion of the fibers, or a network formed of connecting fibrils of component (B).

2. The synthetic fibers of claim 1 wherein polyester (A) is polyethylene terephthalate or polybutylene terephthalate.

3. The synthetic fibers of claim 1 wherein the polyalkylene oxide has a number average molecular weight of 400 to 20,000.

4. The synthetic fibers of claim 1 wherein the content of the polyalkylene oxide in (B) is 10 to 90% by weight, and the amount of the polyalkylene oxide content of the fibers is 0.5 to 15% by weight.

5. The synthetic fibers of claim 1 wherein (B) is present in the form of bands.

6. The synthetic fibers of claim 1 wherein (B) is present in the form of a network.

7. The synthetic fibers of claim 5 wherein 3 to 50 bands are present.

8. The synthetic fibers of claim 7 wherein 5 to 30 bands are present.

9. The synthetic fibers of claim 1 wherein the 5-alkali metal sulfoisophthalic acid is a 5-sodium sulfoisophthalic acid.

* * * * *